United States Patent [19]

Bogner

[11] 4,295,141

[45] Oct. 13, 1981

[54] DISC-ON-ROD END-FIRE MICROWAVE ANTENNA

[76] Inventor: Richard D. Bogner, 4 Hunters La., Roslyn, N.Y. 11576

[21] Appl. No.: 149,664

[22] Filed: May 14, 1980

Related U.S. Application Data

[63] Continuation-in-part of Ser. No. 938,883, Sep. 1, 1978, abandoned.

[51] Int. Cl.[3] ..... H01Q 13/28

[52] U.S. Cl. ..... 343/753; 343/785

[58] Field of Search ..... 343/785, 753, 833, 909

[56] References Cited

U.S. PATENT DOCUMENTS 2,663,797 12/1953 Kock ..... 343/785

2,955,287 10/1960 Bogner ..... 343/785

*Primary Examiner*—Eli Lieberman

*Attorney, Agent, or Firm*—Leonard H. King

[57] ABSTRACT

A disc-on-rod end-fire type antenna is disclosed in which close to optimum gain is maintained over a large range of antenna lengths, using the same disc size and spacing for all lengths.

12 Claims, 8 Drawing Figures

DISC-ON-ROD END-FIRE MICROWAVE ANTENNA

This application is a continuation-in-part of co-pending application Ser. No. 938,883 filed Sept. 1, 1978 and now abandoned.

BACKGROUND OF THE INVENTION

Certain television broadcast services, such as the Multipoint Distribution Service, also known as MDS, have created a requirement for reliable inexpensive microwave antennas. The antennas must meet rather demanding requirements. At the present time, MDS stations under FCC regulations transmit with only 10 watts of power and, accordingly, a high gain antenna is desirable. Receiving locations are often at single occupancy dwellings, which requires that for reasons of economic feasibility the cost of installation be minimal. Reliability is important to avoid the cost of service calls. Low wind load and ease of installation are other factors.

I have found that the disc-rod antennas of the general type disclosed in my prior U.S. Pat. No. 2,955,287 issued on Oct. 4, 1960, may be utilized in supplying the present requirement. However, as will be explained hereinafter, only a narrow range of the previously indicated useful range of disc size and spacing may be utilized for the purposes of the present invention.

The disc-on-rod type antenna, excited by a launcher or elementary antenna as described in the above-referenced patent, can take the form of uniformly spaced discs or plates of uniform size and shape. In general, the design as described in the above-referenced patent required that to achieve optimum gain for a given element length (measured in wavelength) the plate size and spacing be selected for that particular length. Therefore, a length change to increase or reduce gain to meet system requirements was of necessity accompanied by either loss of optimum gain for the element length which is, in effect, a less efficient design, or require a change of plate size and/or spacing. I have found that there is a design, however, which is such that the longer the element the higher the gain at a given frequency, with no requirement to change plate size or spacing, but only length, to change gain and remain within a few percent of optimum gain for the element length.

Thus, use of a simple launcher, as e.g. a probe-excited open end wave guide or pair of dipoles, in conjunction with a simple mount to a mast which allows either horizontal or vertical polarization and pointing change in azimuth and elevation, and in conjunction with a disc-on-rod designed to be optimum over a large range of length with the same plate dimension and spacing throughout, can allow an installer to use no more than the required disc-on-rod length for each location. The length may, in practice, be varied in many simple ways, such as adding length in steps, replacement with units of different length, or actually adding or removing plates individually.

I have found that the plate shape, size, and spacing which are optimum for this purpose are: plates which are round thin flat discs normal to the axis, of constant diameter D where (D-d) is in the range of 0.23λ to 0.27λ, and of spacing between 0.18λ and 0.23λ (where d is the diameter of the conductive support). In this range the gain can be made to be within a few percent of optimum as a function of length for a range of lengths 3λ to 12λ long. The disc-on-rod having these parameters provides a gain of 4 db above the launcher gain to 9 db above the launcher gain. The wavelength, λ, is the wavelength of the signal of interest.

The above brief description, as well as further objects, features and advantages of the present invention, will be more fully appreciated by reference to the following detailed description of a presently preferred, but nonetheless illustrative, embodiment in accordance with the present invention when taken in conjunction with the accompanying drawings.

BRIEF DESCRIPTION OF THE DRAWINGS

FIG. 5 is a plan view of a section of a disc-rod radiator;

DETAILED DESCRIPTION OF THE PREFERRED EMBODIMENT

Figures 1, 2, 3, 4:
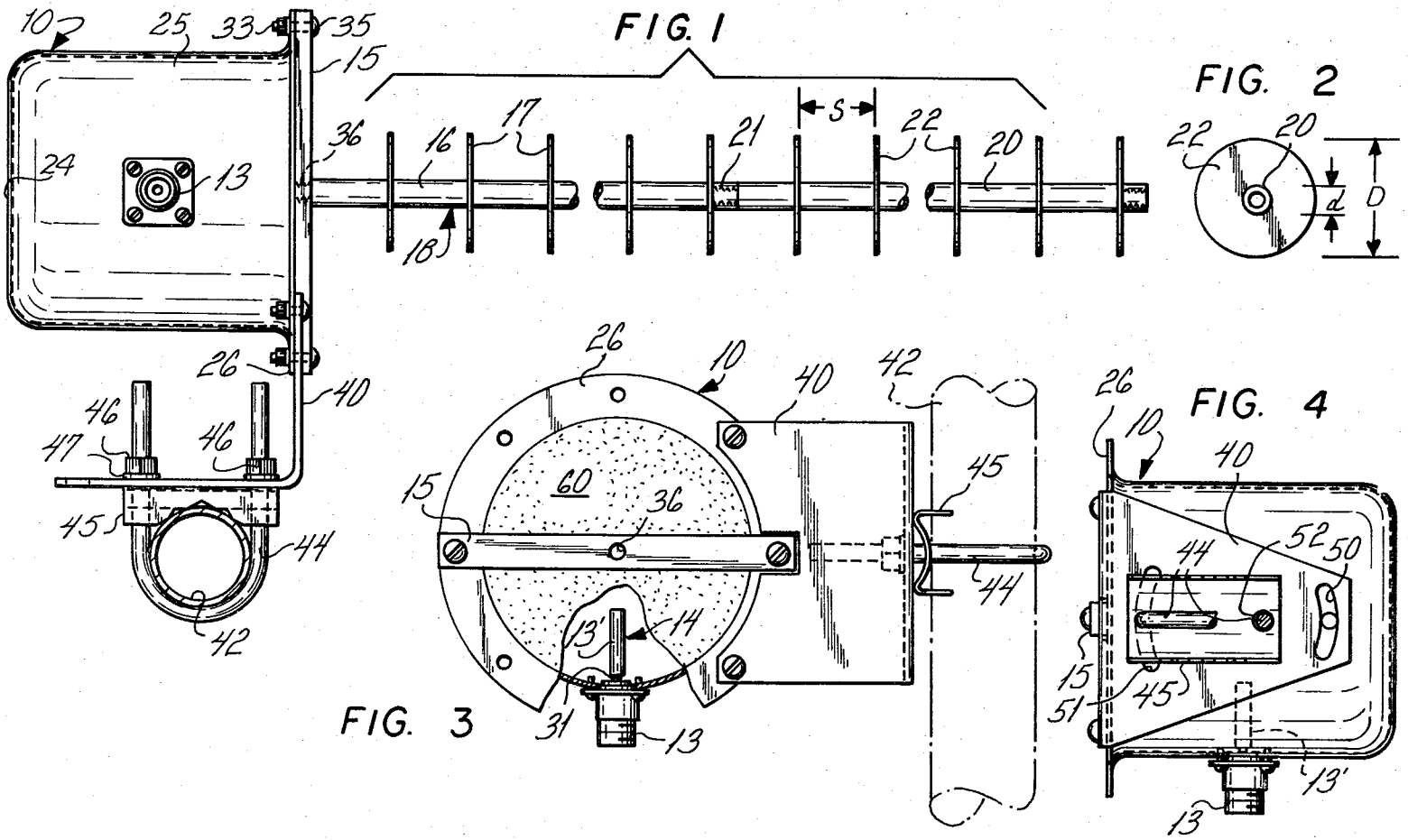
FIG. 1 is a bottom plan view of the antenna of this invention with a disc-rod radiator member.
FIG. 2 is an elevational end view of a typical disc-shaped plate.
FIG. 3 is a front elevational view of the launcher and mounting bracket assembly with a portion of the foam filling and flange broken away to expose a probe member.
FIG. 4 is a side elevational view thereof.

Referring now to FIG. 1 there is shown a waveguide section 10, a coaxial transmission line connector 13 for coupling probe 14 (FIG. 3) which extends into the waveguide 10, to a receiver. A support member 15 extends across the mouth of the waveguide. A disc-rod assembly 18, supported by number 15, extends outwardly. The assembly consists of an electrically conductive axial rod 16 of diameter d and transverse spaced discs 22 of diameter D. Each of the rods terminates in a coupling 21 adapted to receive an additional successive member 18.

It is important that each installation be made at a minimum cost consistent with adequate performance. Thus, the locations close to the transmitter site a waveguide launcher, operating at 2 GHz, with a gain typically of e.g. 11 dBi (dB above an isotrope) may be adequate. If not, the installer may add one disc-rod section of about e.g. one foot in length and containing about 10 discs to achieve a total gain of 15 dBi. By adding another section, a gain of 16.5 dBi is achieved. A third addition of a one foot long section will bring the gain to 18 dBi. A fourth addition of a like section can bring it to over 20 dBi.

The preferred waveguide member 10 configuration consists of a round container 25 about 4" in diameter and 4" deep for use at 2 GHz. At other frequencies these dimensions should be scaled in inverse proportion. The container is formed of one piece with a closed back 24 and an integral flange 26. Extending through the wall there is a standard "N" type coaxial connector 13 with a tubular metal extension 13' attached by solder or crimped to center conductor 31 of the connector to form a probe 14 for excitation of the waveguide. Two such probes orthogonally mounted could be used for bi or circular polarization. The integral flange 26 receives a support member 15 which is secured thereto by nuts 33 and screws 35. A central threaded bore 36 receives disc-rod assembly 18. The flange 26 also provides a base for receiving a bracket 40 which permits mounting the antenna to a mast 42 by means of "U" bolt 44 and ridged saddle 45. The saddle ridges prevent rotation of the antenna about the mast when nuts 46 are properly tightened against lock washers 47.

As shown in FIG. 3 the probe 14 is oriented vertically to provide a vertically polarized signal. Electrically conductive support bar 15 positioned transverse to the probe 14 does not interfere with the signal. If it is desired to transmit a horizontally polarized signal, the cavity 10 is rotated 90° thereby orienting the probe 14 horizontally and the support bar 15 vertically. The bracket may be moved along flange 26 to accomplish this.

As shown in the side elevational view of FIG. 4, a bracket is provided with a pair of angular slots 50 and 51 for receiving a "U" bolt. Opening 52 cooperates with opening 51 to receive a small size U-bolt, while a larger size U-bolt will fit slots 50 and 51. The annular slot permits angular elevation positioning of the antenna.

To prevent the waveguide from filling with water, the cavity is filled with a block of foamed polystyrene 60. A foam density of ½ to 3 pounds/cu foot is suitable.

In an alternative construction, not shown, the foam filling may be omitted and a synthetic resin cover such as polyester sheet, say, 0.05" thick used to cover the open waveguide. In this case it is desirable to have one or more holes about 0.125" in diameter formed in the wall at a normally lowest portion to permit water to escape.

It has been discovered that by restricting the plate spacing and dimension D (FIG. 2) transverse to the axis of the end-fire radiator to a specific range much narrower than that recited in my aforementioned U.S. Pat. No. 2,955,287, there is a significant improvement obtained. In particular, there is employed an end-fire radiator of a length between 3λ and 12λ, having a principal axis adapted to be energized by the launcher at the non-radiating end of said radiator for the transmission of energy of wavelength λ in the direction of the axis, the electrically active components of said radiator consisting of a plurality of substantially identical thin electrically conductive plates spaced between 0.18λ and 0.23λ apart, along said axis, with the plane of the plates normal to said axis, wherein (D-d) is greater than 0.23λ and less than 0.27λ where λ is the wavelength of the signal of interest. In FIG. 5 there is defined "S" as the spacing between plates (center to center) "D" as the plate dimension in plane of the electric field, "d" as the dimension of the electrically conductive plate supporting rod and "L" as the length of the end fire antenna.

Figure 6:
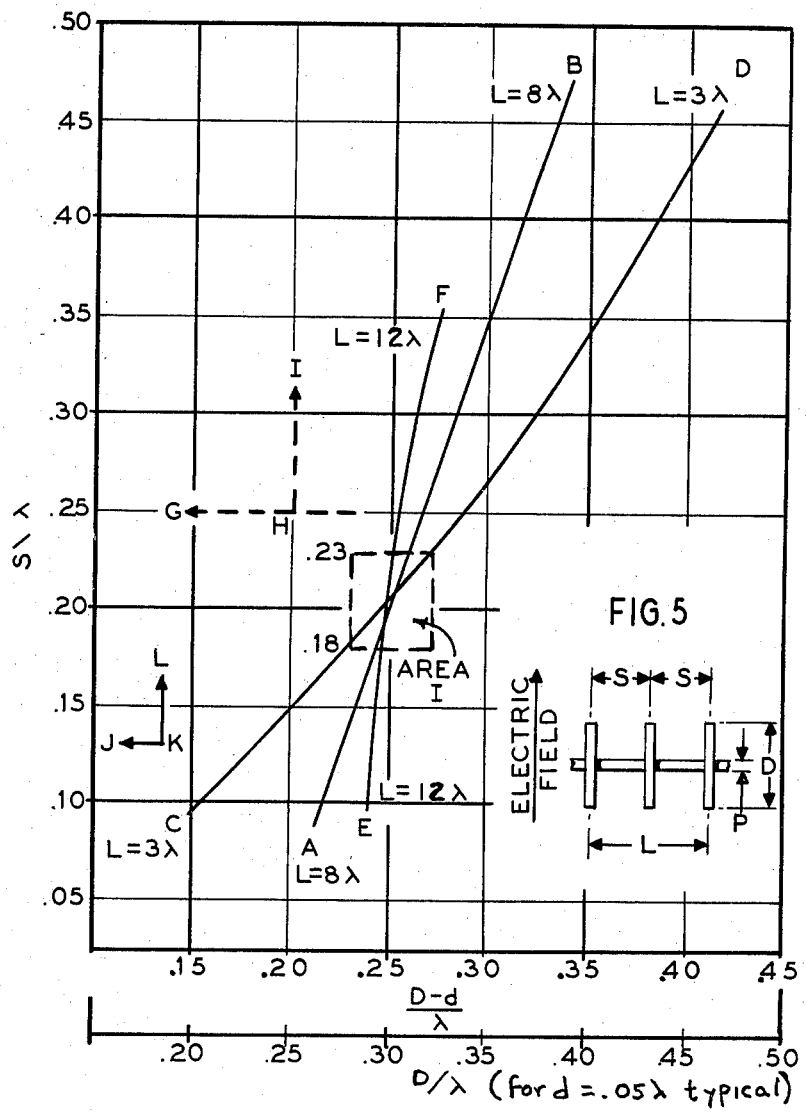
FIG. 6 is a plot of a series of curves showing maximum gain of a discrete metallic member end-fire antenna of various lengths as a function of member dimension and spacing.

FIG. 6 shows clearly that there is a special previously unsuspected critical range of (D-d) and S in which almost optimum design is obtained for a large range of practical lengths with the same physical parameters, allowing use of "add-on" sections to obtain a desired gain without significant performance degradation for most lengths used. In FIG. 6 curve A-B was taken exactly from U.S. Pat. No. 3,440,658. This patent does not disclose that the curves for longer and shorter elements behaved as they do, i.e. they all cross within a small region, (Area I, FIG. 6) meaning that operating in that region and only in that region allows one to do what is the object of this patent application.

My prior U.S. Pat. No. 3,440,658 states that any configuration of plate spacing and diameter along this line provides maximum gain. However, for the purposes of this invention only a small portion of this range is usable. More specifically my prior patents (see also U.S. Pat. No. 2,955,287) indicate a diameter of about λ/3 is desired.

The range of S of 0.18λ to 0.23λ encompass the region of operation Area I as can be seen from FIG. 6.

Notice that the range of (D-d) is claimed 0.23λ to 0.27λ i.e. below and above λ/4, the actual range of D is always in practice above λ/4 since as a practical matter d is always greater than 0.02λ.

The plates are not required to be flat and can have substantial thickness, the spacing S being measured between center lines of plates. While round plates are most convenient from a production and assembly standpoint other shapes may be employed provided the dimension D is based on a measurement in the electric field of the signal.

TABLE I

The following table shows the relationships between cost based on disc area vs. D/λ for elements of L = 8 for d = 0.05

| D/λ | S/λ | NO DISCS | DISC AREA | N = COST |
|---|---|---|---|---|
| .26 | .075 | 107 | .053 | 5.67 |
| .29 | .17 | 47 | .066 | 3.10 |
| .35 | .35 | 23 | .096 | 2.21 |
| .39 | .47 | 17 | .119 | 2.02 |

It has been past practice to utilize the lowest cost configuration. However for the purposes of this invention more expensive configurations are required.

Figure 7:
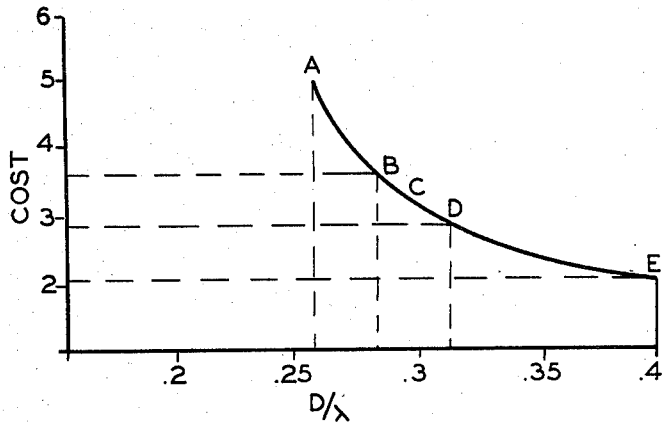
FIG. 7 is a plot of a curve of relative cost vs. disc size.

FIG. 7 shows curve A-E derived from the curve in FIG. 6 for L=8λ (typical) based on the foregoing Table I showing that the claimed range (B-C-D on curve) is outside the minimum cost area (E on curve) which would normally be used.

Prior art end-fire antennas employed entirely different ranges well outside the ranges claimed herein for the purposes of this invention. For example W. E. Kock U.S. Pat. No. 2,663,797 specifies that "each of said discs having a diameter slightly less than one quarter wavelength" and a thickness of substantially one twentieth wavelength and "uniformly spaced apart by more than λ/4 and less than λ/2".

In FIG. 6 line GHI outlines the range cited by Kock which is clearly outside the range claimed herein as shown by Area I.

In summary, Kock requires a spacing of greater than 0.25λ, and applicant specifies less than 0.23λ, Kock requires a diameter less than 0.25λ and applicant specifies a diameter greater than 0.25λ.

Other prior art antennas which employ spaced plate end-fire elements include the "Cigar Antenna" (JPL Review) which utilizes a disc spacing of 0.128λ to 0.165λ and disc diameter 0.100λ to 0.137λ which are outside the range claimed hereinafter. This is shown by the lines JKL in FIG. 6.

Thus it has been shown that the disc dimensions and spacing which must be utilized to provide an end-fire element which suitably may be of various lengths are contrary to accepted practice to operate in the dimensional range claimed hereinafter.

Figure 8:
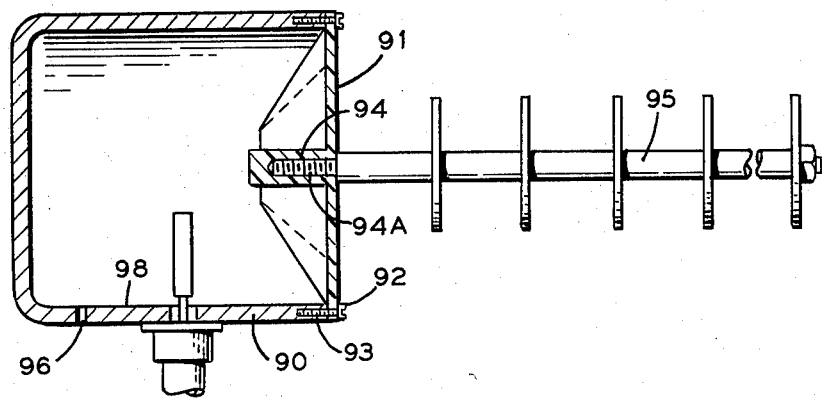
FIG. 8 is an elevational view taken in cross-section of an alternative embodiment of the antenna.

In FIG. 8 there is shown an alternative embodiment of this invention wherein the wall 90 of antenna 80 is sufficiently thick to receive screws 92 in threaded bores 93. A molded plastic radome 91 seals the opening secured by the screws 92. The radome 91 is provided with a threaded bore 94 to receive the threaded end 94*a* of disc-rod 95. Drain hole 99 permits any water that may collect to drain away eliminating the need for foam packing.

In terms of wavelength the cavity 98 is preferably around $\frac{3}{4}$ wavelength in diameter, and $\frac{1}{2}$ to 1 wavelength deep.

Thus, there has been disclosed a simple, highly reliable and inexpensive high gain antenna. A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein. For example, member 16 may be non-conductive and, therefore, d=o, or an external non-conductive tube, or foam blocks between plates, may be used for support.

What is claimed is:

1. A plate-on-rod end-fire antenna comprising a launcher and end-fire radiator exhibiting close to optimum gain over a range of lengths between 3λ and 12λ where λ is the wavelength at the operating frequency, and having a principal axis adapted to be energized by the launcher at the non-radiating end of said radiator for the transmission of energy wavelength λ in the direction of the axis, the electrically active components of said radiator consisting of a plurality of substantially thin identical electrically conductive round plates substantially uniformly spaced between 0.18λ and 0.23λ apart, along said axis, with the plane of the plates normal to said axis, to form an elongated radiator fitting within a circumscribing cylinder, coaxial with said principal axis, the difference between the diameter of said cylinder and the diameter of an axial conductive support rod supporting said plates being greater than 0.23λ and less than 0.27λ.

2. A plate-on-rod end-fire antenna comprising:

(a) a launcher for radiating a signal of wavelength λ, and (b) a plate-on-rod end-fire radiator element exhibiting close to optimum gain over a range of lengths between 3λ and 12λ where λ is the wavelength at the operating frequency comprising an axial conductive support rod, having a length of between 3λ and 12λ, and a dimension "d" transverse to the axis of said rod and a plurality of thin plates substantially uniformly spaced between 0.18λ and 0.23λ along said rod, said plates having a dimension D in a plane containing both the electric vector of the signal radiated by said launcher and the element axis, and wherein the difference between the dimension D and the dimension d of said axial conductive support rod supporting said plates being greater than 0.23λ and less than 0.27λ.

3. The antenna of claims 1 and 2 wherein the plate-on-rod assembly is comprised of a plurality of said plate-on-rod sections adapted to be coupled together.

4. The antenna of claim 2 wherein the plates are round.

5. The antenna of claims 1 and 2 wherein the launcher is a one piece container having a tubular waveguide section with an integral back and an open end thereof.

6. The antenna of claims 1 or 2 wherein the launcher is a waveguide filled with foamed plastic.

7. The antenna of claims 1 and 2 wherein the launcher is a one-piece container having a tubular waveguide section with an integral back and open end and an outwardly radially extending flange at the open end thereof.

8. The antenna of claim 7 wherein said container is filled with plastic foam.

9. The antenna of claim 8 wherein a coaxial connector is attached to the wall of said container and having a center conductor extending into the interior of the said container and a tubular extension affixed to the said center conductor.

10. The antenna of claim 8 wherein said foam is polystyrene foam having a density of about one pound per cubic foot.

11. The apparatus of claim 1 wherein said launcher is of the cavity type having side electrically conductive rear and side walls defining the cavity and an open end, said walls being sufficiently thick to receive screws for securing means for supporting said end-fire radiator in front of said open end.

12. The apparatus of claim 1 wherein said cavity is about $\frac{3}{4}$ wavelength in diameter and between around $\frac{1}{2}$ to 1 wavelength deep.

* * * * *